US007484622B2

(12) United States Patent
Winckels

(10) Patent No.: US 7,484,622 B2
(45) Date of Patent: Feb. 3, 2009

(54) PACK FOR AN ARTICLE AND A METHOD OF PACKAGING AN ARTICLE

(75) Inventor: Mathilde Winckels, Asnieres (FR)

(73) Assignee: L'oreal, Paris (FR)

( * ) Notice: Subject to any disclaimer, the term of this patent is extended or adjusted under 35 U.S.C. 154(b) by 226 days.

(21) Appl. No.: 10/986,293

(22) Filed: Nov. 12, 2004

(65) Prior Publication Data

US 2005/0121353 A1 Jun. 9, 2005

Related U.S. Application Data

(60) Provisional application No. 60/524,644, filed on Nov. 25, 2003.

(30) Foreign Application Priority Data

Nov. 13, 2003 (FR) ..... 03 50828

(51) Int. Cl.
*B65D 69/00* (2006.01)

(52) U.S. Cl. ..... 206/581; 206/503; 220/669

(58) Field of Classification Search ..... 206/581, 206/575, 224, 385, 443, 446, 503, 504, 507, 206/508; 220/669, 671
See application file for complete search history.

(56) References Cited

U.S. PATENT DOCUMENTS

| | | | | |
|---|---|---|---|---|
| 1,803,239 A | | 4/1931 | Deane | |
| 2,176,944 A | | 10/1939 | Ringler | |
| 2,965,280 A | * | 12/1960 | Miller | 229/110 |
| 3,929,271 A | | 12/1975 | Meyers | |
| 4,846,394 A | * | 7/1989 | Swanson | 229/4.5 |
| 5,518,168 A | * | 5/1996 | Mayer | 229/102 |

FOREIGN PATENT DOCUMENTS

| | | |
|---|---|---|
| DE | 8708115 | 6/1987 |
| EP | 0 322 259 | 6/1989 |
| EP | 0 949 151 | 10/1999 |
| FR | 2 699 889 | 7/1994 |
| FR | 2 752 824 | 3/1998 |
| FR | 2 777 865 | 10/1999 |
| GB | 649736 | 1/1951 |

* cited by examiner

*Primary Examiner*—Mickey Yu
*Assistant Examiner*—Steven A. Reynolds
(74) *Attorney, Agent, or Firm*—Oblon, Spivak, McClelland, Maier & Neustadt, P.C.

(57) ABSTRACT

The invention relates to a pack for an article and a method of packaging an article in a pack. The article can include, for example, a cosmetic product. The pack can include a cylindrical body whose cross-section includes at least one convex curved portion and at least one concave curved portion having a radius of curvature similar to the radius of curvature of the convex portion. The cylindrical body can be formed of at least one sheet conformed to the cross-section and whose side edges can be fastened pairwise to one another along at least one fastening zone extending longitudinally to the body. The sheet can define an opening at least at one end of the body.

50 Claims, 3 Drawing Sheets

PACK FOR AN ARTICLE AND A METHOD OF PACKAGING AN ARTICLE

CROSS REFERENCE TO RELATED APPLICATIONS

This document claims priority to French Application Number 03 50828, filed Nov. 13, 2003 and U.S. Provisional Application No. 60/524,644, filed Nov. 25, 2003, the entire contents of both of which are hereby incorporated by reference.

BACKGROUND OF THE INVENTION

1. Field of the Invention

This invention relates to a pack for an article, in particular an article containing a cosmetic product.

2. Discussion of Background

Packs for articles can come in many shapes, such as parallelepipedal or cylindrical shapes. The shape is generally a function of the shape of the article that is to be contained within the pack. Parallelepipedal packs, or at least packs having two flat faces, offer the advantage that they can be stacked during transport and also on shelving in shops, which is not the case with cylindrical packaging.

It has consequently been proposed, particularly in EP 0 322 259, to provide a pack of a generally cylindrical shape comprising along the entire height of its side wall a groove as well as a rib. When several of these packs are stacked, the rib of a first pack lies in the groove of a second pack. The stack obtained with such packs is relatively stable.

However, the cylindrical shape is obtained by molding which means that it is necessary to transport empty packs from the line on which they are molded to the line on which the article is packaged. FR 2752824 also describes a pack formed by two shells that are fastened to one another and whose shape is obtained by molding. Because such packs are fairly bulky, the volume that has to be transported is large, making transport costs relatively high even though only empty packs are transported.

In order to reduce the space occupied by packaging during its transportation, there are generally used packs in the form of cartons that are obtained from a precut blank which is folded to produce the final shape. Blanks can be transported flat, which means that they occupy very little space. The cartons are then erected just before or at the same time as the article to be packaged is placed inside them.

However, a precut blank can only be used to produce parallelepipedal or cylindrical cartons such as those illustrated for example in FR 2 777 865, U.S. Pat. No. 3,929,271 or EP 0 949 151.

SUMMARY OF THE INVENTION

Consequently, it is one of the objects of the invention to provide a pack for an article that can be stacked on other identical packs in a relatively stable manner, for example on shop shelving.

It is in particular an object of the invention to provide such a pack which, before the article to be packed is placed inside it, can be transported without occupying much space.

It is a further object of the invention to provide a pack of this kind which is low in cost.

According to one embodiment of the invention, these objects can be achieved by providing a pack for an article, for example an article containing a cosmetic product, the pack including a cylindrical body whose cross-section has at least one convex curved portion and at least one concave curved portion having a radius of curvature similar to the radius of curvature of the convex portion. The cylindrical body can be made from at least one sheet conformed to the cross-section and whose side edges are fastened pairwise to one another in at least one fastening zone extending longitudinally to the body. The sheet can define an opening at least at one end of the body. The sheet can define an opening at each end of the body.

Because the body of the pack is made from a sheet, the pack can be transported before it is assembled since it occupies very little space. Also, because the body has a cross-section with a concave portion and a convex portion having a similar radius of curvature, the pack can be stacked on another pack made in accordance with the invention. In this case, the convex portion of a first pack can be accommodated in the concave portion of a second pack.

The cylindrical body can be made from at least two sheet portions fastened to one another along at least two fastening zones extending longitudinally to the body. In this embodiment, the first sheet portion can be conformed to the convex curved portion of the cross-section and the second sheet portion can be conformed to the concave curved portion of the cross-section. The convex curved portion can be substantially circular, oval or elliptical.

The pack can also include a bottom lid and a top lid adapted respectively to close the bottom and top ends of the body. At least one of the top or bottom lids can be molded integrally with the second portion of the body sheet. The lids can be formed by a flat wall having a flange adapted to abut the internal surface of the body.

The side edges of the sheet can be fastened by snap-fastening, adhering, welding or gripping. In a first embodiment, one edge can include at least two lugs each adapted to snap into an opening formed on the other edge. In another embodiment, one edge can include a grip adapted to grip the other edge.

The sheet can be made of cardboard or a thermoplastic material, for example polypropylene.

An embodiment of the invention also has as an object, separately or in combination with the foregoing, a pack for an article, for example an article containing a cosmetic product, the pack including a cylindrical body whose cross-section has at least one convex curved portion and at least one concave curved portion having a radius of curvature similar to the radius of curvature of the convex portion. The cylindrical body can be made from at least one sheet conformed to the cross-section and whose side edges are fastened pairwise to one another along at least one fastening zone extending longitudinally to the body. The sheet can be substantially flat before the side edges are fastened.

Another embodiment of the invention corresponds to a method of packaging an article in a pack of the kind described hereabove. The method can include the steps of winding a sheet onto a mandrel to form a body, fastening one edge of the sheet to the other edge of the sheet, closing the bottom end of the pack body with a bottom lid, introducing the article into the pack, and closing the top end of the pack body with a top lid.

If the sheet is formed from two sheet portions, one edge of a first sheet portion can be first fastened to one edge of a second sheet portion before the sheet is wound onto a mandrel.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
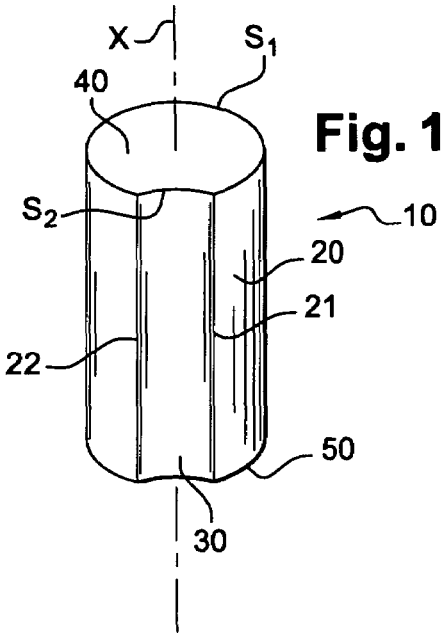
FIG. 1 is a perspective view of a first embodiment of a pack of the invention.
Figure 3:
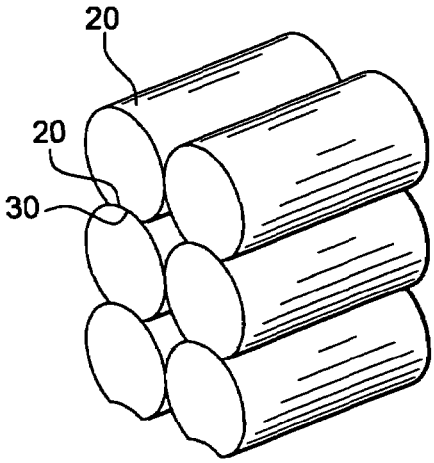
FIG. 3 is a perspective view of a group of several of the packs shown in FIG. 1.

The pack 10 shown in FIGS. 1 and 3 includes a body of longitudinal axis X, whose cross-section includes a convex curved portion S1 and a concave curved portion S2 extending along the entire axial height of the body.

Figure 2:
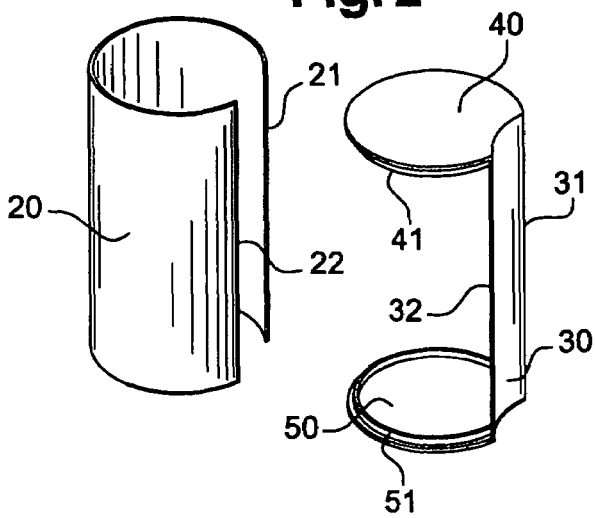
FIG. 2 is an exploded view of the pack of FIG. 1.

As seen in FIG. 2, the body of the pack 10 includes a first sheet portion 20 conformed to the convex curved portion S1 of the cross-section, and a second sheet portion 30 conformed to the concave curved portion S2 of the cross-section.

The first sheet portion 20 can be made from polypropylene and has two edges 21 and 22 that can be parallel to one another and to the axis X. In the assembled position of the pack, the two edges 21 and 22 are radially separated from one another by the second sheet portion 30. The convex curved portion S1 can be generally circular as shown in FIG. 1, but alternatively it could be oval or elliptical.

The second sheet portion 30 can also be made from polypropylene. Preferably, it is substantially thicker than the first sheet portion, such as to be relatively stiff. It can have the shape of an elongated roof tile. When the pack is in the assembled position, the concave curved portion S2 preferably has a radius of curvature substantially identical to that of the convex curved portion S1, so that the two curved portions S1 and S2 are of complementary shape.

If the convex curved portion S1 is elliptical or oval, the concave curved portion S2 is preferably on the largest side of the ellipse or oval and has the same curvature as the curvature of the convex curved portion which lies opposite it on the body.

Each of edges 21 and 22 of the first sheet portion 20 can be, for example, welded to the second sheet portion 30 along each of its edges 31 and 32. Alternatively, the edges 21 and 22 can be adhered to the second sheet portion 30. Other fastening mechanisms are within the scope of the invention, as would recognize a person of ordinary skill in the art.

Figure 5:
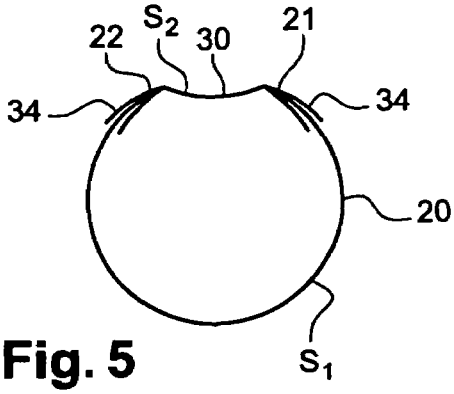
FIGS. 5 and 6 are variant embodiments of a fastening portion of the pack.
Figure 6:
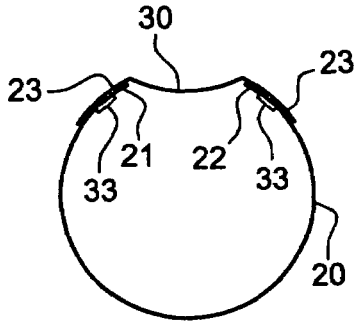

For instance, according to one variant shown in FIG. 5, edges 21 and 22 can be gripped by a grip 34 formed along the length of the second sheet potion 30. According to another variant, shown in FIG. 6, the edges 21 and 22 can include openings 23 into which there are snapped lugs 33 formed on each of the edges of the second sheet portion 30, along its length.

It will be appreciated that the two edges 21 and 22 of the first sheet portion 20 can each be fastened in a different manner to the second sheet portion 30, for example by welding one and gripping the other.

The two ends of the body can be closed by a top lid 40 and a bottom lid 50. The section of each of the lids preferably corresponds substantially to the section of the body lying transversely to the axis X. The lids can be formed by a substantially circular wall having about its periphery a flange 41 and 51 intended to radially abut the internal surface of the first sheet portion 20.

In order to obtain the pack described hereabove, the first sheet portion 20 can be obtained by molding, for example by extrusion or injection, to give a relatively flexible sheet. The second sheet portion 30 and the lids 40 and 50 can also be obtained by molding, for example by extrusion or injection, to give a relatively stiff concave rod carrying the two lids 40 and 50. The zone which connects the lids 40 and 50 to the second sheet portion 30 can be folded on a concave curve corresponding to the shape of the concave curved portion S2.

Alternatively, the lids 40 and 41 can be molded separately and the second sheet portion 30 can be molded alone.

Figure 4A:
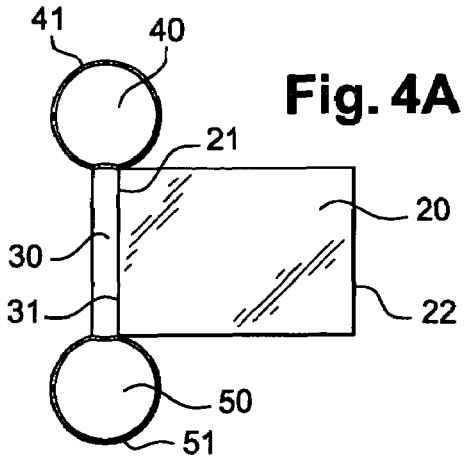
FIGS. 4A to 4E show the different stages of a method of packaging an article in the pack according to one embodiment of the invention.

One edge 21 of the first sheet portion 20 can then be fastened to one edge 31 of the second sheet portion 30 by welding it for example along its entire length, as shown in FIG. 4A.

Figure 4B:
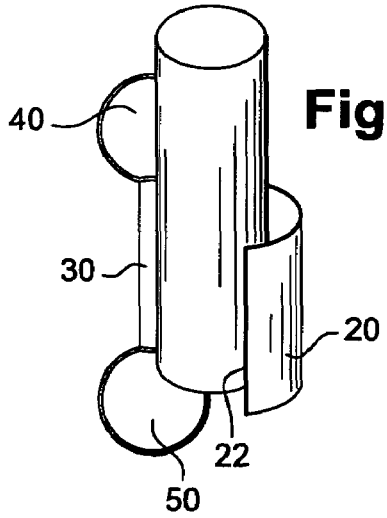

The two sheet portions can be wound around a mandrel having, for example, a circular cross-section. The edge 22 opposite the first edge 21 can be fastened to the other edge 32 of the second sheet portion 30, also by welding, as shown in FIG. 4B.

Figure 4C:
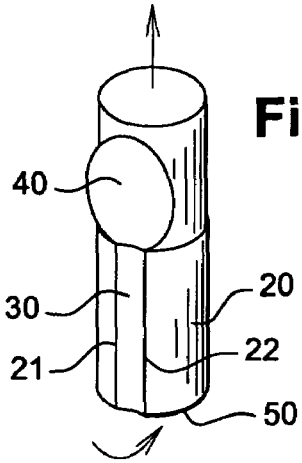

The bottom end of the body can be closed by means of the bottom lid 50 which is folded and pressed into the opening of the body (FIG. 4C).

Figure 4D:
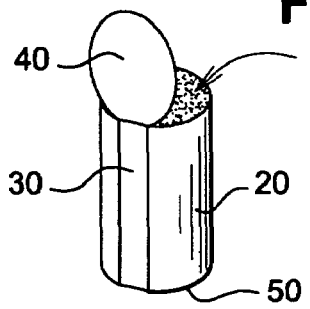
Figure 4E:
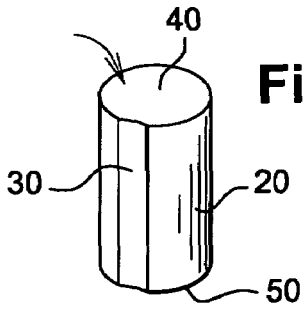

After the mandrel has been removed, the article that is to be packaged can be introduced into the pack as shown in FIG. 4D, the top end of the body can then be closed with the top lid 40 (FIG. 4E).

Packs obtained in this manner can be stacked on top of one another, as shown in FIG. 3, even though they are generally cylindrical in shape.

Moreover, because these packs can be erected at the time the article is introduced into them, they can be transported, without occupying much space, to the line on which the article is introduced. The first sheet portions 20 can be transported flat, for example, by being stacked on top of one another. The second concave sheet portions 30, attached to the lids, can also be stacked on top of one another.

Figure 7A:
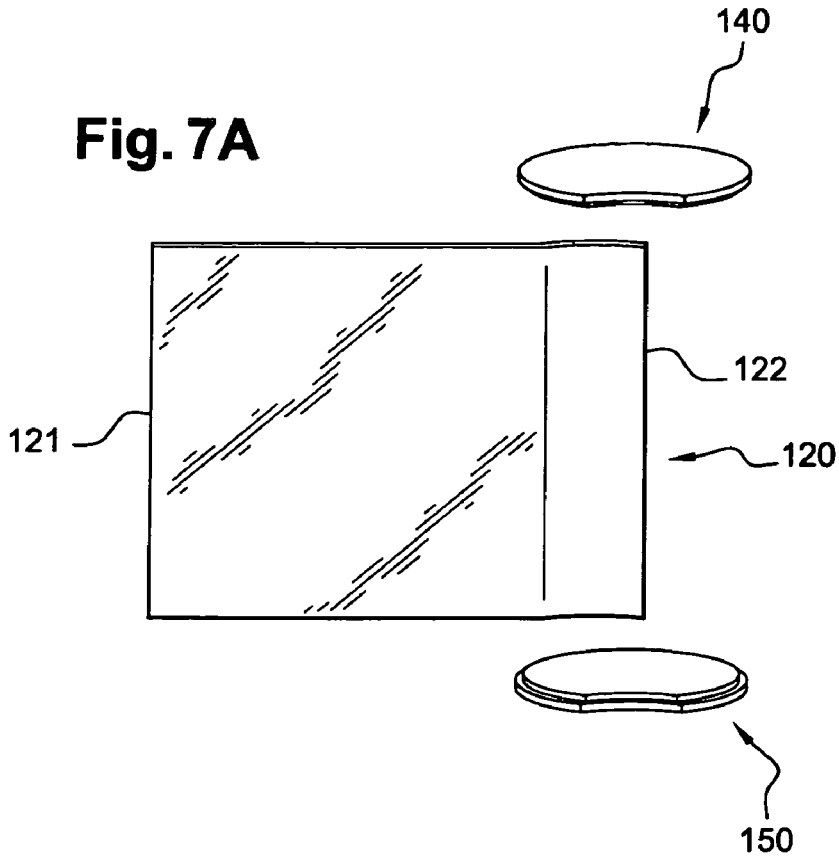
FIGS. 7A and 7B illustrate another embodiment of a pack according to the invention.
Figure 7B:
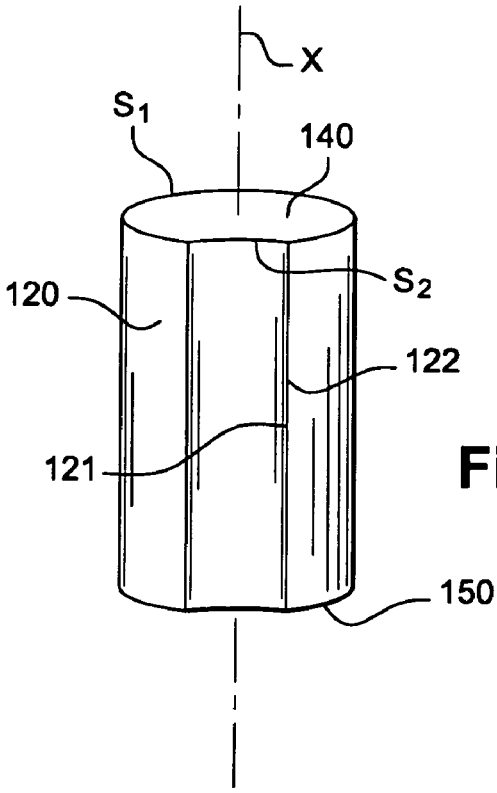

The pack 100 shown in FIGS. 7A and 7B has the same reference numerals as those used for the pack 10 shown in the preceding figures but with 100 added to them. The pack 100 differs from that shown previously in that its body is made from a single sheet 120 and in that the lids 140 and 150 are formed separately, as can be seen in FIG. 7A, which shows the pack 100 before assembly. Also, the convex curved first portion S1 is substantially elliptical.

In order to produce pack 100, the sheet 120 can be made by molding, for example by extrusion or injection, such as to give a relatively flexible, fairly thin part which forms the portion of the body having the convex curved cross-section S1, and a relatively stiff part which forms the portion of the body having the concave curved cross-section S2.

The two lids 140 and 150 can be produced separately, also by molding.

The sheet 120 can be wound around a mandrel having an elliptical cross-section and one edge 121 of the sheet can be fastened to the other edge 122 of the sheet 120 for example by welding.

The bottom end of the body can be closed by a bottom lid 150 which is pressed into the pack opening.

After the mandrel has been removed, the article to be packaged can be introduced into the pack, the top end of the body can be closed with the top lid 140 which is pressed into the body opening. The pack 100 shown in FIG. 7B can thus be obtained.

The pack of the invention can be used for one or more articles. Each article can for example contain a cosmetic product, in particular a makeup or beauty-care product. In one particular example, the pack can contain two articles containing a hair-coloring product.

In the above detailed description, reference was made to preferred embodiments of the invention. Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A pack for an article, the pack comprising:

a cylindrical body having a cross-section comprising at least one convex curved portion and at least one concave curved portion having a radius of curvature similar to a radius of curvature of the convex portion, wherein said cylindrical body comprises at least one sheet conformed to said cross-section, said sheet having side edges fastened pairwise to one another along at least one fastening zone extending longitudinally to said body, the sheet defining an opening at least at one end of the body, wherein the at least one sheet includes a first sheet portion and a second sheet portion, wherein said second sheet portion includes a first lid for closing a top or a bottom of said cylindrical body, said first lid including a convex curved wall and a concave curved wall, and wherein a radius of curvature of the convex curved wall of said first lid is similar to the radius of curvature of the convex curved portion of the cylindrical body and a radius of curvature of the concave curved wall of said first lid is similar to the radius of curvature of the concave curved portion of the cylindrical body such that a profile of said first lid substantially corresponds to said cross-section of said cylindrical body.

2. A pack according to claim 1, wherein the first sheet portion and the second sheet portion are fastened to one another along at least two fastening zones extending longitudinally to said body.

3. A pack according to claim 2, wherein the first sheet portion is conformed to said convex curved portion of the cross-section and the second sheet portion is conformed to said concave curved portion of the cross-section.

4. A pack according to claim 1, wherein the convex curved portion is substantially circular.

5. A pack according to claim 1, wherein the convex curved portion is substantially oval.

6. A pack according to claim 1, wherein the convex curved portion is substantially elliptical.

7. A pack according to claim 1, further comprising a second lid for closing one of the bottom end or top end of the body that is not closed by the first lid.

8. A pack according to claim 7, wherein the first sheet portion is conformed to said convex curved portion of the cross-section and the second sheet portion is conformed to said concave curved portion of the cross-section, and at least one of said first and second lids is formed by molding said at least one lid integrally with the second sheet portion of the body.

9. A pack according to claim 8, wherein each of the first and second lids comprises a flat wall and a flange, said wall being adapted to abut an internal surface of the body.

10. A pack according to claim 8, wherein said concave curved portion of the cross-section is a continuous concave curve that extends uninterrupted from a first longitudinal edge of the second sheet portion to a second longitudinal edge of the second sheet portion such that said continuous concave curve is free of any grooves.

11. A pack according to claim 8, wherein said convex curved portion of the cross-section is a continuous concave curve that extends uninterrupted from a first longitudinal edge of the first sheet portion to a second longitudinal edge of the first sheet portion such that said continuous convex curve is free of any protruding ribs.

12. A pack according to claim 7, wherein said cross section is the same when said first lid and said second lid are both in an open position as when said first lid and said second lid are in a closed position.

13. A pack according to claim 1, wherein said side edges of the sheet are fastened by welding.

14. A pack according to claim 1, wherein the at least one sheet comprises cardboard.

15. A pack according to claim 1, wherein the at least one sheet comprises a thermoplastic material.

16. A pack according to claim 1, wherein the at least one sheet comprises polypropylene.

17. A pack according to claim 1, wherein said article is within said pack.

18. A pack according to claim 17, wherein said article comprises a cosmetic product.

19. A pack according to claim 1, wherein the second sheet portion is thicker than the first sheet portion so as to be more stiff than the first sheet portion.

20. A pack according to claim 19, wherein the second sheet portion is formed of a same material as the first sheet portion.

21. A pack for an article, comprising:

a longitudinal body with a top end and a bottom end, wherein said body comprises a first sheet and a second sheet, said first sheet forming a convex outer wall between said top end and said bottom end of said body, said second sheet forming a concave outer wall between said top end and said bottom end of said body, wherein said first sheet has a first longitudinal edge and a second longitudinal edge, said first and second longitudinal edges being separated from each other by at least a portion of said second sheet, wherein a radius of curvature of said concave outer wall is similar to a radius of curvature of at least a portion of said convex outer wall, wherein said second sheet carries a lid, and wherein a periphery of said lid includes a convex curved portion that includes a radius of curvature that is similar to the radius of curvature of said convex outer wall, and wherein a zone that connects the lid to the second sheet includes a concave curve that corresponds to an edge of the concave outer wall such that the periphery of the lid corresponds in shape to a transverse section of the longitudinal body.

22. A pack according to claim 21, wherein said body is cylindrical.

23. A pack according to claim 21, wherein said portion of said convex outer wall is opposite said concave outer wall.

24. A pack according to claim 21, wherein said radius of curvature of said concave outer wall is equal to said radius of curvature of said portion of said convex outer wall.

25. A pack according to claim 21, wherein a transversal cross-section of said convex outer wall is a portion of a circle.

26. A pack according to claim 21, wherein a transversal cross-section of said convex outer wall is a portion of an ellipse.

27. A pack according to claim 26, wherein said concave outer wall is positioned along a long side of said ellipse.

28. A pack according to claim 21, wherein a transversal cross-section of said convex outer wall is a portion of an oval.

29. A pack according to claim 28, wherein said concave outer wall is positioned along a long side of said oval.

30. A pack according to claim 21, wherein said first longitudinal edge is fastened to said second sheet between said top and bottom ends of said body.

31. A pack according to claim 30, wherein said second longitudinal edge is fastened to said second sheet between said top and bottom ends of said body.

32. A pack according to claim 31, wherein said first longitudinal edge is fastened to said second sheet in a first manner, said second longitudinal edge is fastened to said second sheet in a second manner, which is different from said first manner.

33. A pack according to claim 30, wherein said second sheet is thicker than said first sheet and is stiffer than said first sheet.

34. A pack according to claim 33, wherein the second sheet is formed of a same material as the first sheet.

35. A pack according to claim 30, wherein said concave outer wall forms a continuous concave curve that extends uninterrupted from said first longitudinal edge to said second longitudinal edge such that said concave outer wall is free of any grooves.

36. A pack according to claim 30, wherein said convex outer wall forms a continuous convex curve that extends uninterrupted from said first longitudinal edge to said second longitudinal edge such that said convex outer wall is free of any grooves.

37. A pack according to claim 21, wherein said first longitudinal edge is parallel to said second longitudinal edge.

38. A pack according to claim 21, wherein said lid is a top lid configured to close said top end of said body.

39. A pack according to claim 38, wherein a portion of said top lid is integral with said second sheet such that the zone that connects the lid to the second sheet is foldable along the concave curve that corresponds to the edge of said concave outer wall.

40. A pack according to claim 38, further comprising a bottom lid configured to close said bottom end of said body.

41. A pack according to claim 40, wherein said first sheet includes a cross section that is the same when said top lid and said bottom lid are both in an open position as when said top lid and said bottom lid are in a closed position.

42. A pack according to claim 41, wherein said top lid and said bottom lid each include a flange at their periphery that extends into an interior of said body in a closed position.

43. A pack according to claim 41, wherein said top lid and said bottom lid each include a flange at their periphery, and an outside surface of said flange is in contact with an interior surface of said first sheet in the closed position, and wherein the outside surface of said flange is not in contact with said first sheet in the open position.

44. A pack according to claim 40, wherein at least one of said top lid and said bottom lid include a flange at their periphery that abuts an internal surface of said first sheet in a closed position.

45. A pack according to claim 40, wherein at least one of said top lid and said bottom lid include a flange at their periphery that extends into an interior of said body in a closed position.

46. A pack according to claim 21, wherein said first sheet comprises polypropylene.

47. A pack according to claim 46, wherein said second sheet comprises polypropylene.

48. A pack according to claim 21, wherein said first sheet is fastened to said second sheet along said first and second longitudinal edges.

49. A pack according to claim 21, wherein said article is within said pack.

50. A pack according to claim 49, wherein said article comprises a cosmetic product.

* * * * *